United States Patent [19]

Tami

[11] Patent Number: 4,693,197

[45] Date of Patent: Sep. 15, 1987

[54] SEWING MACHINE APPARATUS WITH IMPROVED SHAFT SPEED MEASURING AND INDICATING MEANS

[75] Inventor: Kazuya Tami, Chofu, Japan

[73] Assignee: Tokyo Juki Industrial Co., Ltd., Tokyo, Japan

[21] Appl. No.: 868,794

[22] Filed: May 29, 1986

[51] Int. Cl.[4] ..... D05B 69/18

[52] U.S. Cl. ..... 112/277; 112/445; 112/121.11; 318/318

[58] Field of Search ..... 112/277, 275, 220, 121.11, 112/445; 318/315, 318, 313, 341, 327, 561

[56] References Cited

U.S. PATENT DOCUMENTS

| | | | |
|---|---|---|---|
| 4,386,301 | 5/1983 | Neki et al. | 112/277 X |
| 4,393,796 | 7/1983 | Dunn et al. | 112/445 |
| 4,602,581 | 7/1986 | Neki et al. | 112/277 |

*Primary Examiner*—Peter Nerbun

*Attorney, Agent, or Firm*—Morgan & Finnegan

[57] ABSTRACT

A detector for detecting the angular position of the main shaft of a sewing machine and the indicator apparatus of a sewing machine are utilized to output the RPM of the main shaft to the indicator apparatus. The detector detects the cycle time of the main shaft rotation by referencing a clock signal and comparing it with preset data. Thereby, the RPM of the main shaft is determined.

1 Claim, 3 Drawing Figures

$5_1$- $5_5$---INDICATE CIRCUIT
7---CONTROL CIRCUIT
8---ROM
10---TIMER
11---COUNTER
12---COMPARISON CIRCUIT $5_1$~ $5_5$---INDICATE CIRCUIT
7---CONTROL CIRCUIT
8---ROM
10---TIMER
11---COUNTER
12---COMPARISON CIRCUIT

SEWING MACHINE APPARATUS WITH IMPROVED SHAFT SPEED MEASURING AND INDICATING MEANS

BACKGROUND OF THE INVENTION

The invention relates to an apparatus for measuring the rotation of a sewing machine and, more particularly, for indicating the number of rotations and allowing adjustment thereof Adjustment of the rotational speed ("RPM") of a sewing machine has previously been accomplished by measuring the RPM of the sewing machine with a tachometer. Accordingly, the tachometer must be securely fixed to the main shaft of the sewing machine and then rotational speed is adjusted. Adjustment of the sewing machine in this manner is rather complicated and there is generally some error in measurement by the tachometer.

SUMMARY OF THE INVENTION

With the foregoing in mind, it is an object of the invention to provide a simple and accurate sewing machine apparatus that automatically measures and indicates the RPM of the sewing machine.

The apparatus according to the invention comprises a means to store the measured RPM of the sewing machine, a circuit that detects a signal synchronized with the main shaft rotation, and a circuit which determines the cycle time of the sewing machine by counting the cycles of the synchronized signal. A circuit then compares the cycle time of the synchronized signal with the predetermined RPM and a circuit indicates the rotational speed of the sewing machine based on the result of comparing the cycle time with the measured RPM. Thus, the RPM of the sewing machine is measured without any rotation meter and, thereby, speed adjustment of the sewing machine is facilitated and accurate adjustment of the sewing machine is secured.

BRIEF DESCRIPTION OF THE DRAWINGS

The accompanying drawings, referred to herein and constituting a part hereof, illustrate a preferred embodiment of the invention and, together with the description, serve to explain the principles of the invention wherein.

DETAILED DESCRIPTION OF THE DRAWINGS

Figure 1:
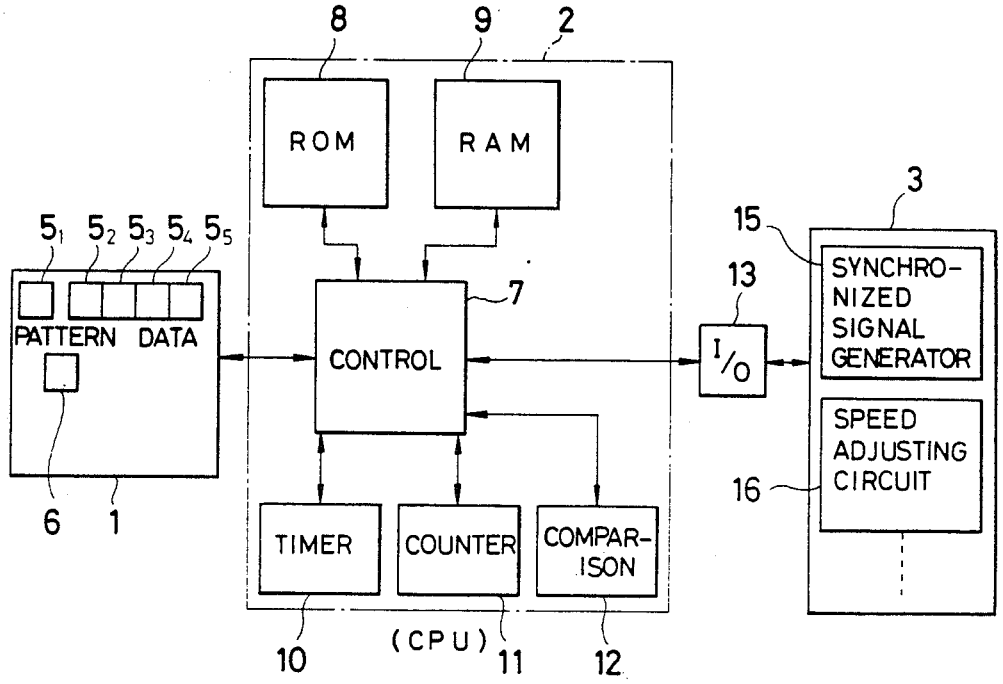
FIG. 1 is a block diagram of a preferred embodiment of the invention.

Referring to the accompanying drawings, one embodiment of the present invention will be explained. FIG. 1 is a block diagram of the embodiment according to the invention illustrating its essential functions. FIG. 1 is organized primarily into console 1, control section 2, and motor control section 3. Indicator circuit $5_1$—$5_5$ of console 1 and test switch 6 are connected to control circuit 7 of the control section 2. Control circuit 7 comprises ROM (read only memory) 8, RAM (random access memory) 9, timer 10, counter 11, and comparison circuit 12. To control circuit 7, a synchronized signal generator 15, of a type well-known in the art for generating signals synchronized with the main shaft rotation, and a speed adjusting circuit 16, also of a type well-known in the art employing a VF (volt frequency) converter or others, are connected via an I/0 (input/output) circuit 13. A timer 10, consisting of an 8 bit formation which overflows at a count of 256, has its overflow output connected to a counter 11. The control circuit 7 generates a reference clock signal of 0.08 m sec base time.

Figure 2A:
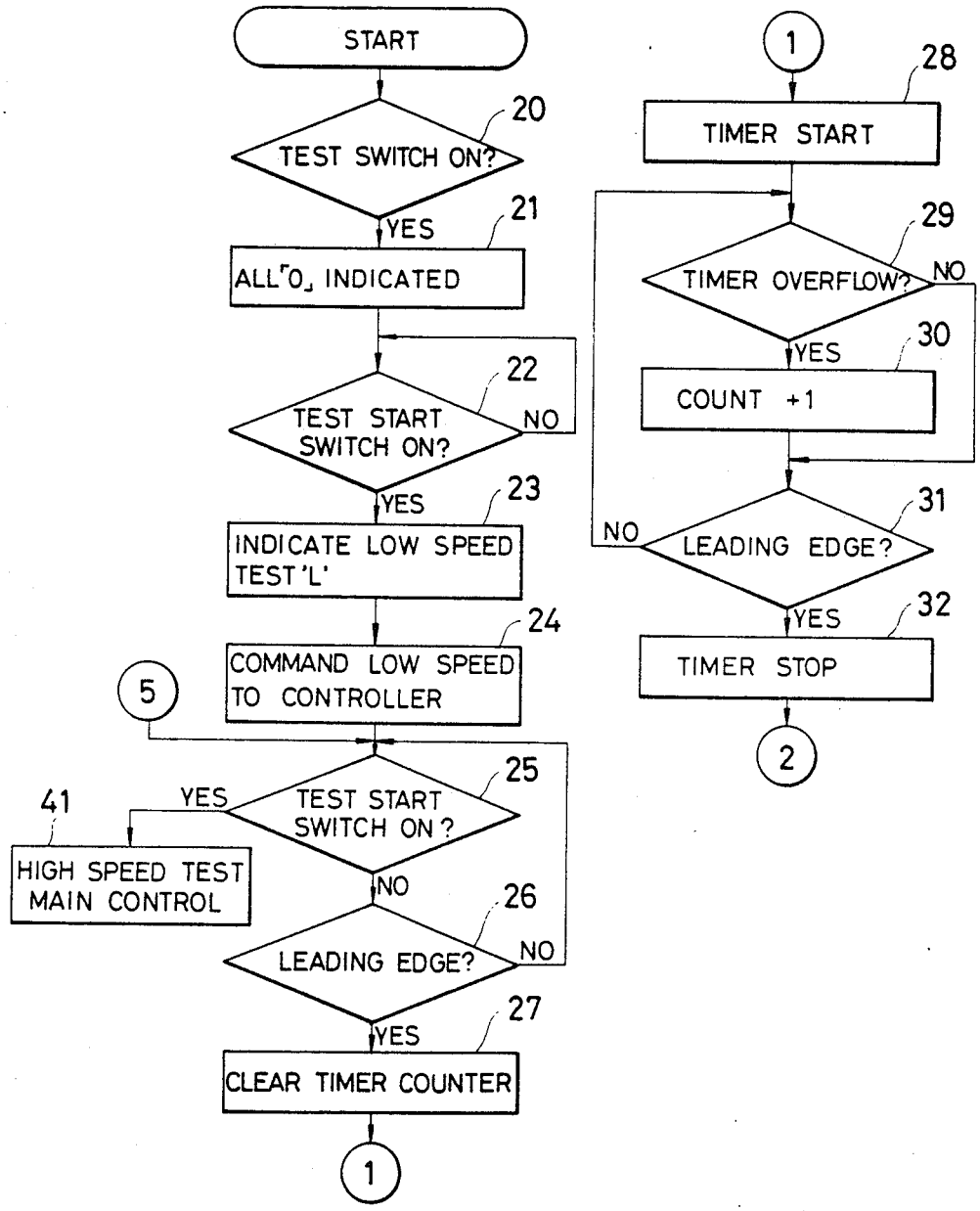
FIGS. 2A and 2B are flow charts describing the operation of a preferred embodiment of the invention.
Figure 2B:
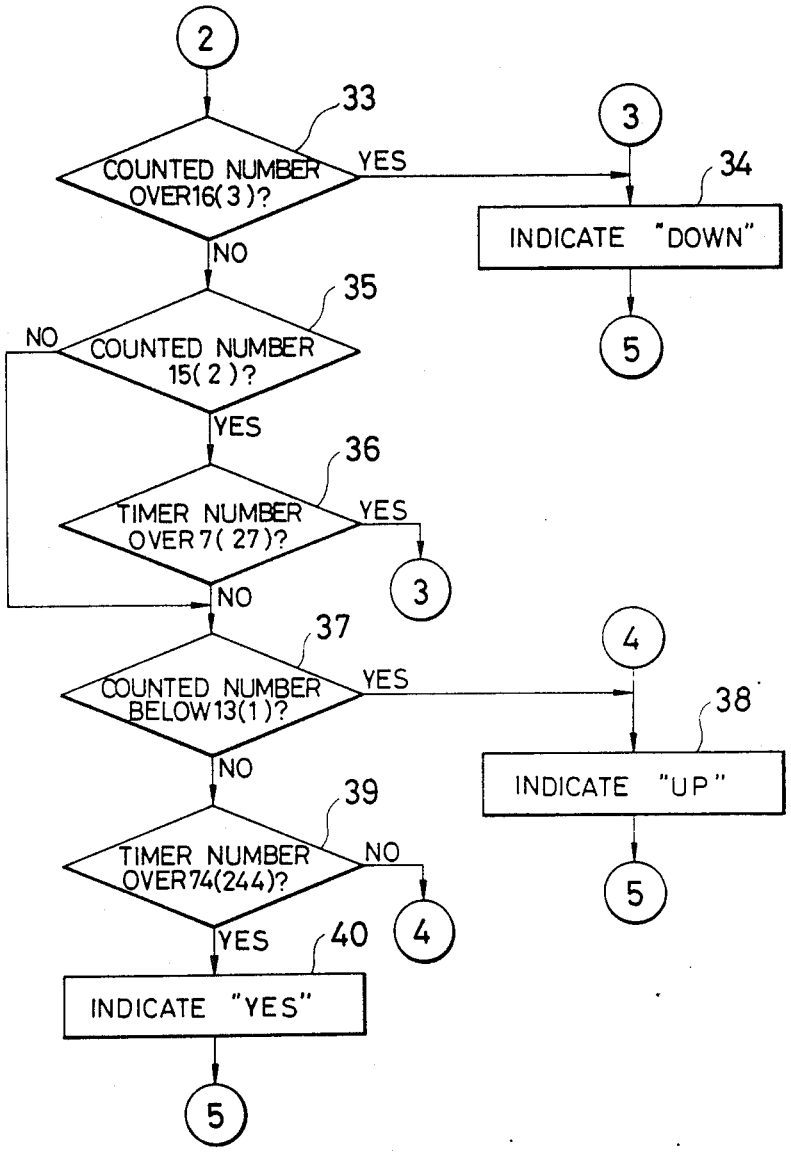

FIG. 2A and FIG. 2B are flow charts illustrating the operation of an embodiment according to the present invention. and the programs based on said flow charts are stored in a ROM (read only memory) 8.

The characteristic operation of the embodiment of the present invention, as described above, will now be explained. If test switch 6 on the console 1 is switched on, the control circuit 7 reads the speed test program from the ROM 8, and the apparatus is ready for sewing machine speed test mode (refer to FIG. 2A, block 20). In this condition, the indicator circuit $5_1$—$5_5$ indicates "0" and the operator knows the apparatus is now in test mode (refer to FIG. 2A, block 21). When the operator switches on the switch 6 again, the indicating circuit $5_1$ indicates "L" (low speed) and the apparatus is in low speed adjust mode (refer to FIG. 2A, blocks 22, 23).

In adjusting sewing machine speeds, two kinds of speeds may be set in the program. One is 200 RPM (low speed) and the other is 1500 RPM (high speed). Allowance for adjusting the low speed is ±5 RPM, thus the adjustment range is 195–205 RPM. For high speed, the adjustment range is 1400–1500 RPM. When the mode is changed to low speed adjustment, the control circuit 7 orders "low speed" to the motor control section 3 (refer to FIG. 2A, block 24). In case of low speed, the time required per one rotation is 307.692 m sec, at 195 RPM and 292.683 m sec at 205 RPM.

By the above procedure, the sewing machine performs low speed operation and a synchronized signal generator 15 outputs a signal synchronized with main shaft rotation corresponding to each main shaft rotation. Under these conditions, the control circuit 7 determines if the test switch 6 is input again, and if there was no input, monitors the synchronized signal (refer to FIG. 2A, blocks 25, 26). When the control circuit 7 detects start-up of the synchronized signal, the control circuit 7 resets a timer 10 and a counter 11, and the timer 10 subsequently starts (refer to FIG. 2A, blocks 26, 27, 28).

As described above, the timer 10 counts the reference clock (0.08 m sec cycle time) of the control circuit 7 and, when it counts over 256, it outputs the overflow and the timer starts counting from zero. Whenever the timer 10 overflows, the counter 11 adds +1 (refer to FIG. 2A, blocks 29, 30). When the leading edge of the synchronized signal is detected, the control circuit 7 stops the timer 10 (refer to FIG. 2A, block 32). At this point, the numbers counted by the timer 10 and the counter 11 correspond to the cycle time of the sewing machine. If the sewing machine is rotating in the allowable speed range of 195–205 RPM (low speed rotation), the counter counts 15 and the timer indicates 6 (for 195 RPM) or the counter counts 14 and the timer indicates 74 (for 205 RPM).

At first the control circuit 7 compares its counted number with the number (data) at 195 RPM. In short, the control circuit 7 compares to see whether its counted number is over 16 or not at comparing circuit 12, and if the number is over 16, the RPM of the sewing machine is below 195 RPM and the indicator circuit $5_2$ indicates "d" (down) (refer to FIG. 2B, blocks 33, 34).

If "d" is indicated, the operator speeds up its rotation a little by a speed adjusting circuit 16. Under this condition, the control circuit 7 repeats the operations below block 25 down to 5 in FIG. 2A and FIG. 2B.

If the counted number is below 16, it is compared to see if the counted number equals 15 or not. If it equals 15, it is then determined whether the timer number is over 7 or not If not, the data at 205 RPM is to be compared (refer to FIG. 2B, blocks 35, 36). If timer number is over 7, the RPM of the sewing machine is lower than 195, and the indicator circuit $5_2$ indicates "d" (refer to FIG. 2B block 36, 37). In response to the indicator, the operator adjusts the speed adjusting circuit 16. If the timer number is not over 7, the timer number is compared with the data at 205 RPM. In short, whether the counted number is below 13 or not is determined (FIG. 2B, block 37).

If the counted number is below 13, it means that the RPM of the sewing machine is over 205, and the indicator circuit $5_2$ indicates "U" (up) (refer to FIG. 2B, block 38). When "U" is indicated, the operator lowers RPM of the sewing machine a little bit by means of speed adjusting circuit 16. Under these conditions, the control circuit 7 repeats the operations below block 25 (refer to FIG. 2A, 2B, 5).

If the counted number is over 13, since the counted number has been determined to be below 15 (blocks 33, 35), the counted number will be 14, and the timer number will be referred to to ascertain whether it is over 74 or not (refer to FIG. 2B, block 39). If it is not over 74, the RPM of the sewing machine will be higher than 205, and the indicator circuit $5_2$ indicates "U" (refer to FIG. 2B, blocks 39, 38). Responding to the indicator, the operator adjusts the speed circuit 16. If the timer number is over 74, it is certain that RPM of the sewing machine is within the range of 195–205 RPM, and the indicator circuit $5_2$ indicates "Y" (yes). By this adjustment, the operator knows that RPM of the sewing machine is within the range of the predetermined lower speed, and the speed adjustment is finished.

Additionally, until next leading edge of the synchronized signal comes up (refer to FIG. 2A, block 26), whether or not the next test should be performed is determined. If the test switch 6 is input again (refer to FIG. 2A, block 25), the mode switches to high speed rotation adjust mode, and if the test switch 6 is input again, the mode is switched to main control mode (refer to FIG. 2A, block 41). High speed adjustment is conducted in similar manner as low speed adjustment described above.

The indicator circuit $5_1$ indicates "H" (high speed), and the mode switches to high speed rotation adjust mode, and the sewing machine rotates at high speed (refer to FIG. 2A, block 23, 24). The same adjustment method as in case of low speed adjustment is performed. RPM at the high speed rotation will be adjusted within the range of 1400–1500 RPM. This range will be expressed between count number 2, timer number 26; and count number 1, timer number 244. Comparison of the actually measured count number and timer number with the data at 1400 RPM and 1500 RPM may be followed in the flow charts by referring to the numbers indicated in parenthesis in blocks 33, 35, 36, 37 and 39 and other operations are the same as described above.

As previously mentioned, the apparatus of this invention provides a means to detect the RPM of the sewing machine and a means to compare the RPM with the preset data at a predetermined RPM and to indicate the results of said comparison. These means are set in the control section of the sewing machine. Thus, the RPM of the sewing machine is measured without any rotation meter and, thereby, speed adjustment of the sewing machine is facilitated and accurate adjustment of the sewing machine is secured. Checking the RPM of the operating sewing machine is facilitated and accurate control of sewing machine is enabled and, therefore, higher quality of sewing work is achieved.

It is to be understood that the above-described embodiment of the invention is illustrative only and that modifications thereof may be made without departing from the scope and spirit of the invention.

What is claimed:

1. A sewing machine apparatus, comprising:

(a) storage means for storing a preset RPM range of the sewing machine;

(b) means for detecting signals synchronized with rotation of the main shaft of the sewing machine;

(c) means for determining the cycle of time of the sewing machine by referring to said synchronized signals;

(d) means for comparing said cycle time with said preset RPM range;

(e) indicator means for indicating the RPM of the sewing machine as being within said preset RPM range determined by comparing said cycle time with said preset RPM range; and (f) indicator means for indicating the direction of adjustment of the sewing machine RPM to bring the sewing machine RPM within said preset RPM range if the RPM of the sewing machine is not within said preset RPM range.

* * * * *